US008087572B2

(12) United States Patent
Kibbe

(10) Patent No.: US 8,087,572 B2
(45) Date of Patent: Jan. 3, 2012

(54) CONTAINER BLANK FOR A STORAGE CONTAINER

(76) Inventor: Donna J. Kibbe, Derwood, MD (US)

( * ) Notice: Subject to any disclaimer, the term of this patent is extended or adjusted under 35 U.S.C. 154(b) by 306 days.

(21) Appl. No.: 12/250,601

(22) Filed: Oct. 14, 2008

(65) Prior Publication Data

US 2009/0095802 A1 Apr. 16, 2009

Related U.S. Application Data

(60) Provisional application No. 60/979,462, filed on Oct. 12, 2007.

(51) Int. Cl.
*B65D 5/00* (2006.01)

(52) U.S. Cl. ..... 229/126; 229/116.1; 206/748; 206/499

(58) Field of Classification Search ..... 229/126, 229/116.1, 116.3, 116.4, 902, 147; 220/376; 446/73, 488; 206/748, 750, 740, 45.21, 45.25
See application file for complete search history.

(56) References Cited

U.S. PATENT DOCUMENTS

| | | | | |
|---|---|---|---|---|
| 3,481,453 | A * | 12/1969 | Beichler et al. | 206/778 |
| 3,871,520 | A * | 3/1975 | Hand | 206/320 |
| 4,055,250 | A * | 10/1977 | Mayhew | 206/457 |
| 4,431,128 | A * | 2/1984 | Dirico | 229/120.03 |
| 4,643,349 | A * | 2/1987 | Sheffer | 229/116.4 |
| 2004/0124236 | A1 * | 7/2004 | Howard | 229/145 |

* cited by examiner

*Primary Examiner* — Nathan J Newhouse
*Assistant Examiner* — Christopher Demeree
(74) *Attorney, Agent, or Firm* — Edell, Shapiro & Finnan, LLC

(57) ABSTRACT

The present invention is directed toward a blank of material configured to form a storage/display container. The blank includes fold lines at predetermined locations to provide panels selectively foldable into a predetermined configuration. Specifically, the blank forms a container having a pedestal, a tower, and a lid hinged to the tower. The container defines a cavity in which items are selectively stored and accessed. The container, moreover, may function as a component of an award given to an award recipient. In one embodiment, the container is stylized as a trophy housing items related to an accomplishment or an occasion reached by the recipient.

22 Claims, 12 Drawing Sheets

CONTAINER BLANK FOR A STORAGE CONTAINER

CROSS REFERENCE TO RELATED APPLICATIONS

This application claims priority to U.S. Provisional Patent Application No. 60/979,462 filed 12 Oct. 2007 and entitled "Trophy Box and Method of Making Same", the disclosure of which is hereby incorporated by reference in its entirety.

FIELD OF THE INVENTION

The present invention relates generally to a single piece container blank and a container formed from the blank that is capable of holding a variety of items.

BACKGROUND OF THE INVENTION

A typical foldable box is formed from a box blank with folding lines formed therein. The folding lines may include perforations, indentations, slits, scoring, cuts, or any other lines that weaken the integrity of the box blank to enable folding at the weakened lines. Such box blanks are usually cut or stamped from a flat sheet of cardboard. The die used to stamp the blank also scores the blank along selected lines to enable folding of the blank along the scores and, as such, enabling the creation of the finished container. Some examples of known foldable containers include a pizza box and a milk carton.

While these conventional boxes are appropriate for storing and protecting an item during transport, these boxes have limited usefulness, being discarded once the item has been removed. Thus, it would be desirable to provide a container that is aesthetically pleasing, may be customized by a user, as well as is capable of storing and displaying items. It would further be desirable to provide a single piece container blank configured to fold into such a container.

SUMMARY OF THE INVENTION

The present invention is directed toward a container blank configured to form a storage/display container. The blank includes a single sheet of material with fold lines disposed at selected locations, forming panels that are selectively foldable into a predetermined configuration. Specifically, the blank forms a container having a pedestal, a tower, and a lid hinged to the tower. The container defines a cavity in which items are selectively stored and accessed. The container, moreover, may resemble a trophy such that it functions as an award given to an award recipient at an award occasion. The container may further house items related to the award occasion, and may be decorated in a manner corresponding to the occasion.

BRIEF DESCRIPTION OF THE DRAWINGS

Like reference numerals have been used to identify like elements throughout this disclosure.

DETAILED DESCRIPTION OF THE INVENTION

Figure 1:
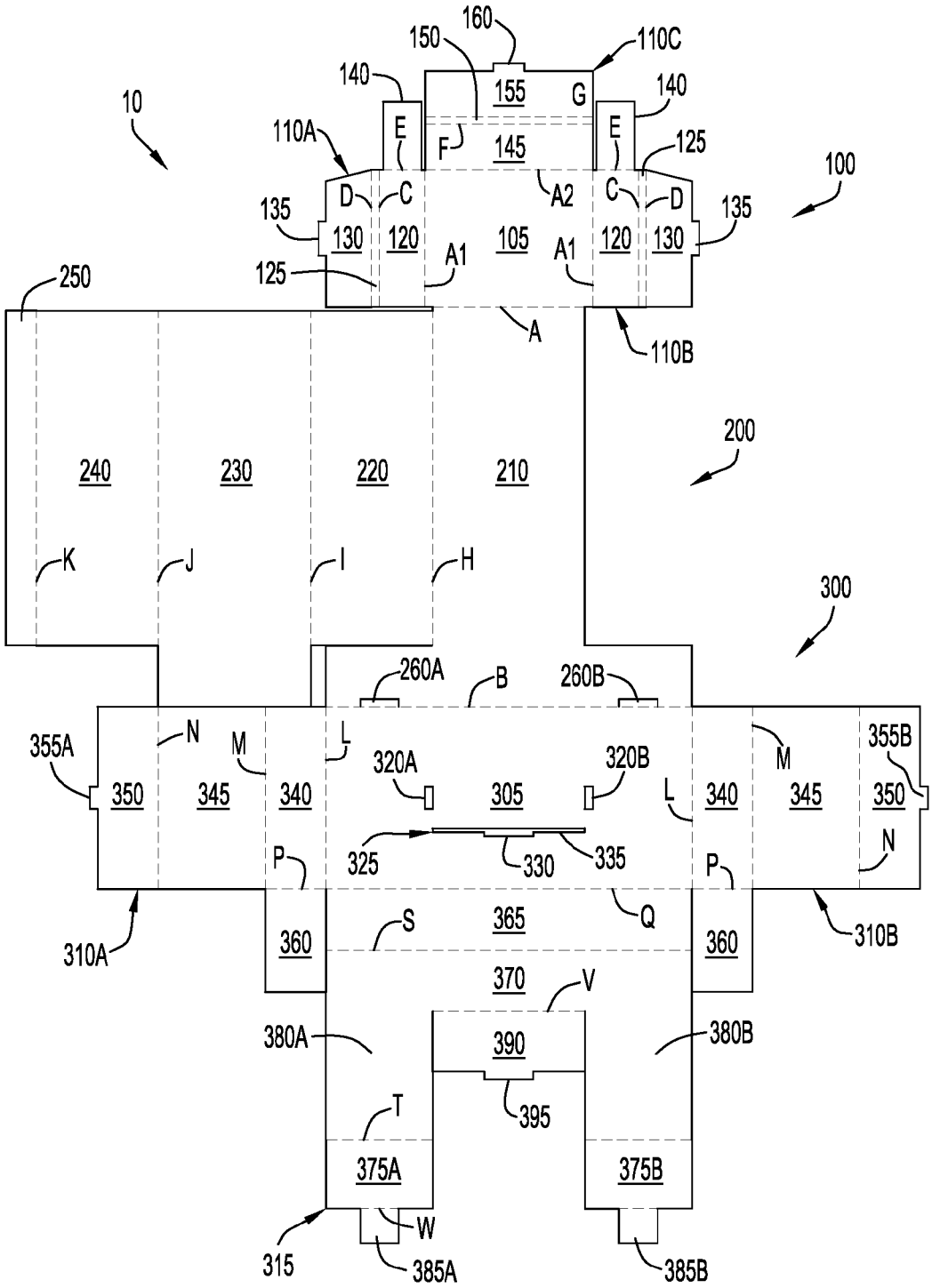
FIG. 1 illustrates a plan view of a blank for a container in accordance with an embodiment of the invention.

FIG. 1 illustrates a top plan view of a blank 10 in accordance with an embodiment of the invention. The one-piece blank 10 is configured to fold into a container having a lid, a tower, and a pedestal or base. In a preferred embodiment, the container is stylized as a trophy having wide base that supports the tower in a generally upright orientation. The blank 10 is preferably constructed from a single piece of formable material including, but not limited to, sheets of cardboard, fiberboard, containerboard, corrugated containerboard, and paperboard. The blank 10 is cut, scored, perforated or otherwise formed with weakened lines to define panels that fold to form the display container. In the figures, cut lines are shown as solid lines and scored/weakened lines as dashed/broken lines.

The blank 10 includes a lid section 100, a tower section 200, and a pedestal or base section 300. The lid section 100 is hinged to the tower section 200 via fold/score line A. Similarly, the tower section 100 is hinged to the pedestal section 300 via fold/score line B. The lid section 100 forms the lid of the container and, in particular, the lid of the tower. The lid section 100 includes a central lid panel 105, a first or left lid panel 110A, a second or right lid panel 110B, and a third or front lid panel 110C. Each panel 110A, 110B, 110C is formed of folding panel portions. Specifically, the left panel 110A includes a proximal or side panel portion 120, an intermediate panel portion 125, and a distal or end panel portion 130. The proximal panel portion 120 is coupled to the central panel portion 105 via fold line A1. The proximal panel portion 120, in turn, is connected to the intermediate panel portion 125 via fold/score line C, and the distal panel portion 130 is connected to the intermediate panel portion 125 via fold/score line D. Similarly, the right panel 110B includes a proximal or side panel portion 120, an intermediate panel portion 125, and a distal or end panel portion 130. The panel portions 120, 125, 130 are similarly hinged via fold lines A1, C, and D, respectively.

The proximal panel portions 120 further include a flap 140 hinged thereto via a fold/score line E. The flaps 140 are captured by portions of the front lid panel 110C when folded, securing the left 110A and right 110B lid panels to the front lid panel, as well as reinforcing the front lid panel. The distal panel portions 130 may also include a pressure tab 135 that frictionally engages the center panel 105 when folded, supporting the wall of the lid when formed. As illustrated, the distal panel portions 130 of the left 110A and right 110B panels may be tapered along their upper edges (from the viewpoint of FIG. 1).

The front lid panel 110C includes a proximal panel portion 145 connected to the central panel portion 105 via fold/score line A2, which, in turn, is connected to an intermediate panel portion 150 along fold/score line F. An end or distal panel portion 155 is connected to the intermediate panel portion 150 via fold/score line G. The distal panel portion 155 may further include a pressure tab 160 extending distally from the panel portion similar to that described above.

The tower section 200 folds to define a compartment operable to receive one or more items. As shown, the tower section 200 includes a first or rear tower panel 210, a second or left tower panel 220, a third or front tower panel 230, and a fourth or right tower panel 240. The rear tower panel 210 and the left tower panel 220 are hinged along fold/score line H. The left tower panel 220 and the front tower panel 230 are connected along score line I, while the front tower panel and the right tower panel 240 are connected via score/fold line J. The fourth tower panel 240 is further hinged to a tower end flap 250 via fold line K. The tower end flap 250 may include a fastener that, when folded, engages the interior surface of the rear tower panel 210. The fastener may include, but is not limited to, a double sided adhesive strip (seen in FIG. 3).

The rear tower panel 210 may be a generally T-shaped structure, with the top of the "T" hinged to the pedestal section 300. The rear tower panel 210 further includes a first slot 260A and a second slot 260B disposed in spaced relation along fold line B. The slots 260A, 260B are aligned and configured to receive tabs 385A 385B of the pedestal section 300 (discussed in greater detail below).

The shape and dimensions of the tower panels 210, 220, 230, 240 are not particularly limited. As illustrated, the rear tower panel 210 and the front tower 230 panels may have similar lengths, possessing a length greater than that of the left 220 and right 240 tower panels, which are also similarly sized. The bottom edge of the front panel 230, moreover, is sized and shaped to mate with a slot 325 formed in the pedestal section 300 (discussed in greater detail below). While generally rectangular panels are shown, it should be understood other shapes (polygons, circles, etc. may form the tower panels 210, 220, 230, 240.

The pedestal section 300 forms a base operable to support the tower section 200 in a generally upright orientation. As shown, the pedestal section 300 includes a central pedestal panel 305, a first or left pedestal panel 310A, a second or right pedestal panel 310B, and a third or top pedestal panel 315. The central pedestal panel 305 includes a first or left notch 320A and second or right notch 320B generally centrally situated and oriented in opposed relation. The central panel 305 further includes an elongated slot 325 having a median groove 330 and a longitudinal groove 335. As noted above, the longitudinal groove 335 is configured to receive the bottom edge of the front tower panel 230.

The left panel 310A includes a proximal panel portion 340 hinged to the central panel 305 via fold/score line L, an intermediate panel portion 345 hinged to the proximal panel portion 340 via fold/score line M, and an end or distal panel portion 350 connected to the intermediate panel portion 345 via fold/score line N. The distal panel portion 350 may further include a left locking tab 355A operable to mate with the first notch 320A formed into the central panel 305. In addition, the proximal panel portion 340 includes a flap 360 foldable along fold/score line P.

Similarly, the right panel 310B includes a proximal panel portion 340 connected to the center panel 305 via fold/score line L, an intermediate panel portion 345 connected to the side panel portion 340 via fold/score line M, and a distal or end panel portion 350 connected to the intermediate panel portion 345 via fold/score line N. The distal panel portion 350 may further include a right locking tab 355B operable to mate with the second notch 320B formed into the central panel 305. In addition, the side panel portion 340 includes a flap 360 hinged along fold/score line P.

The top panel 315 may possess a generally U-shaped structure having a first arm, a medial portion, and a second arm. Specifically, the top wall 315 includes a proximal panel portion 365 hinged to the central panel 305 via fold/score line Q, an intermediate panel portion 370 hinged to the proximal panel portion 365 via fold/score line S, and a distal panel portion 375 hinged to the intermediate panel portion 370 via score line T. The intermediate 370 and distal 375 panel portions include a cut-out area that defines a first arm 380A and a second arm 380B, each having a tab 385A, 385B extending distally therefrom. The tabs 385A, 385B are aligned with and configured to be received by the first slot 260A and the second slot 260B of the rear tower panel 210, respectively (discussed in greater detail below).

The intermediate panel portion 370 further includes a flap 390 foldable via fold/score line V (i.e., the flap 390 is disposed within the well of the "U"). The flap 390 includes a flap tab 395 aligned with and configured to be received by the elongated slot 325 formed into the center wall 305. Specifically, the flap tab 390 is received within the median groove 330 of the elongated slot 325.

FIGS. 2-6 illustrate the formation of the container from the blank 10. It should be understood that the blank 10 may be formed utilizing manual or mechanical means such as a mechanical box erecting equipment, either wholly or partially. In a preferred embodiment, the container is formed by hand.

Figure 2:
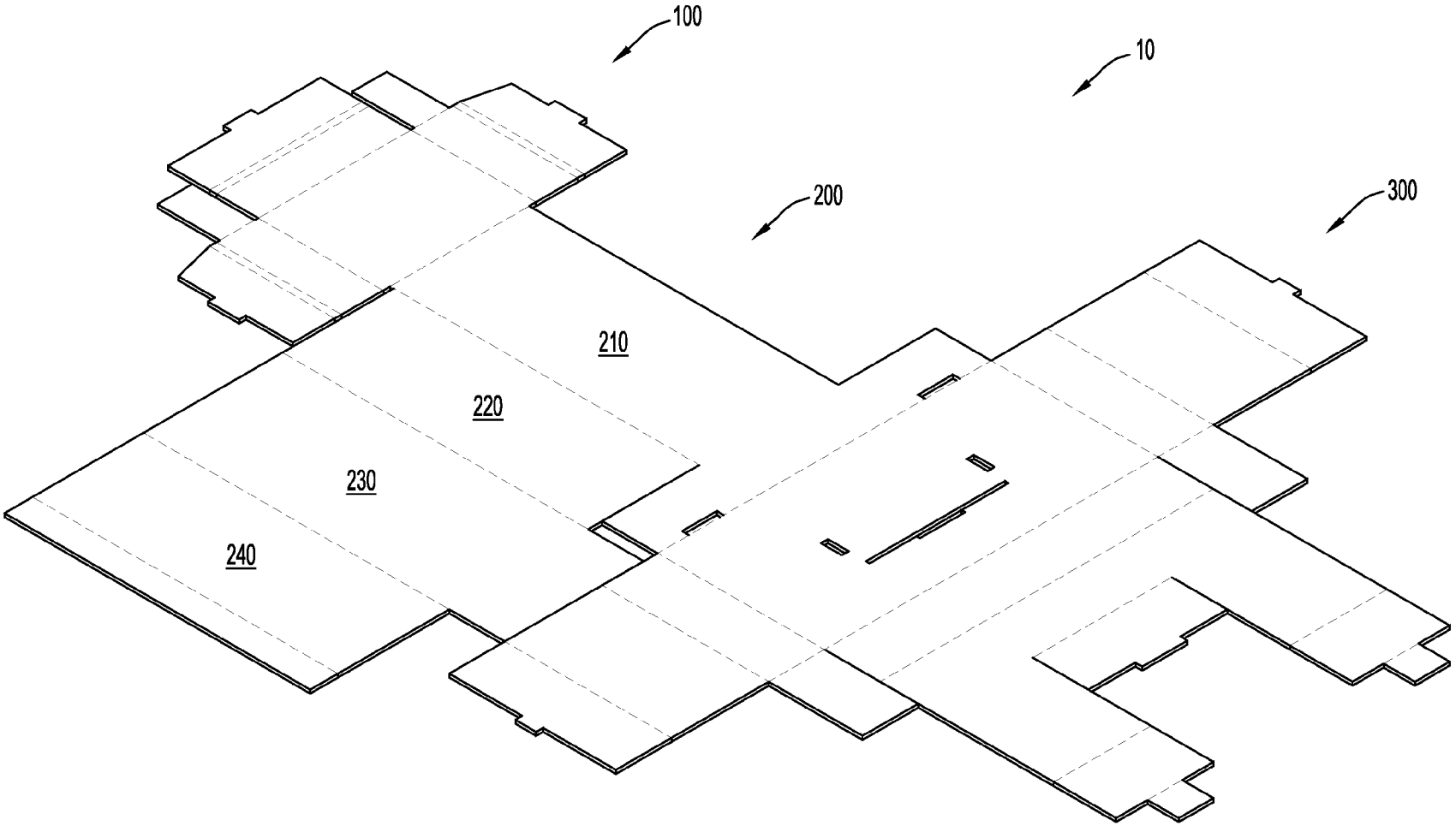
FIG. 2 illustrates a perspective view of the blank of FIG. 1.
Figure 3:
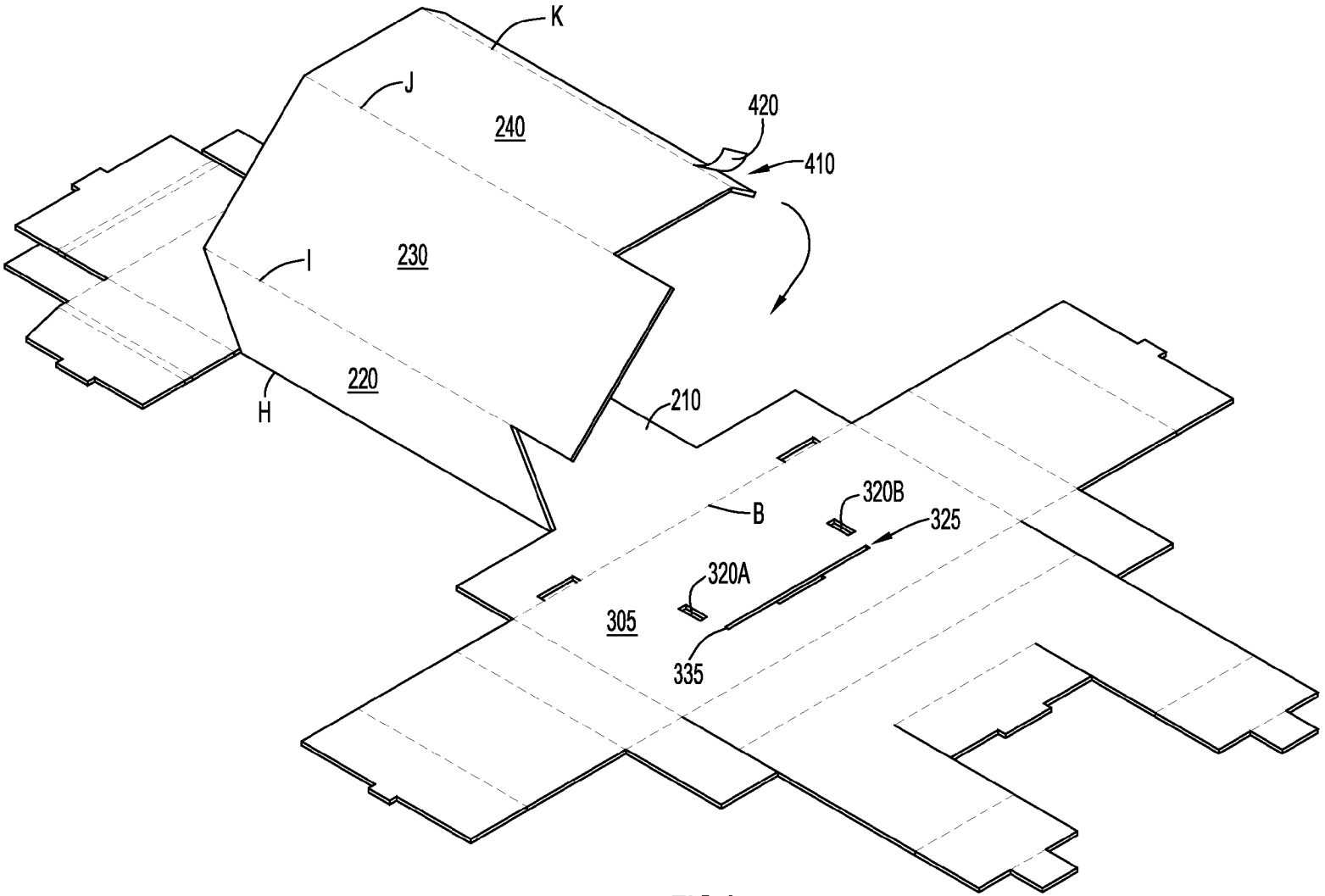
FIGS. 3-4 illustrate perspective views of the blank shown of FIG. 1, showing folding of the tower section along fold lines to from the tower of the container.

FIGS. 2-6 show perspective views of the folding blank illustrated in FIG. 1. Referring to FIGS. 2 and 3, the tower section 200 is formed by pivoting the left panel 220 about fold line H, orienting the end flap 250 adjacent the rear panel 210, and folding the tower panels 210, 220, 230, 240 along their respective fold lines H, I, J, K. When the fastener disposed along the end flap 250 is a piece of double-sided tape 410 having a releasable liner 420, the liner may be removed prior to connecting the end flap 250 to the rear wall 210. Once connected, the tower defines a chamber/channel into which items may be inserted.

Figure 4:
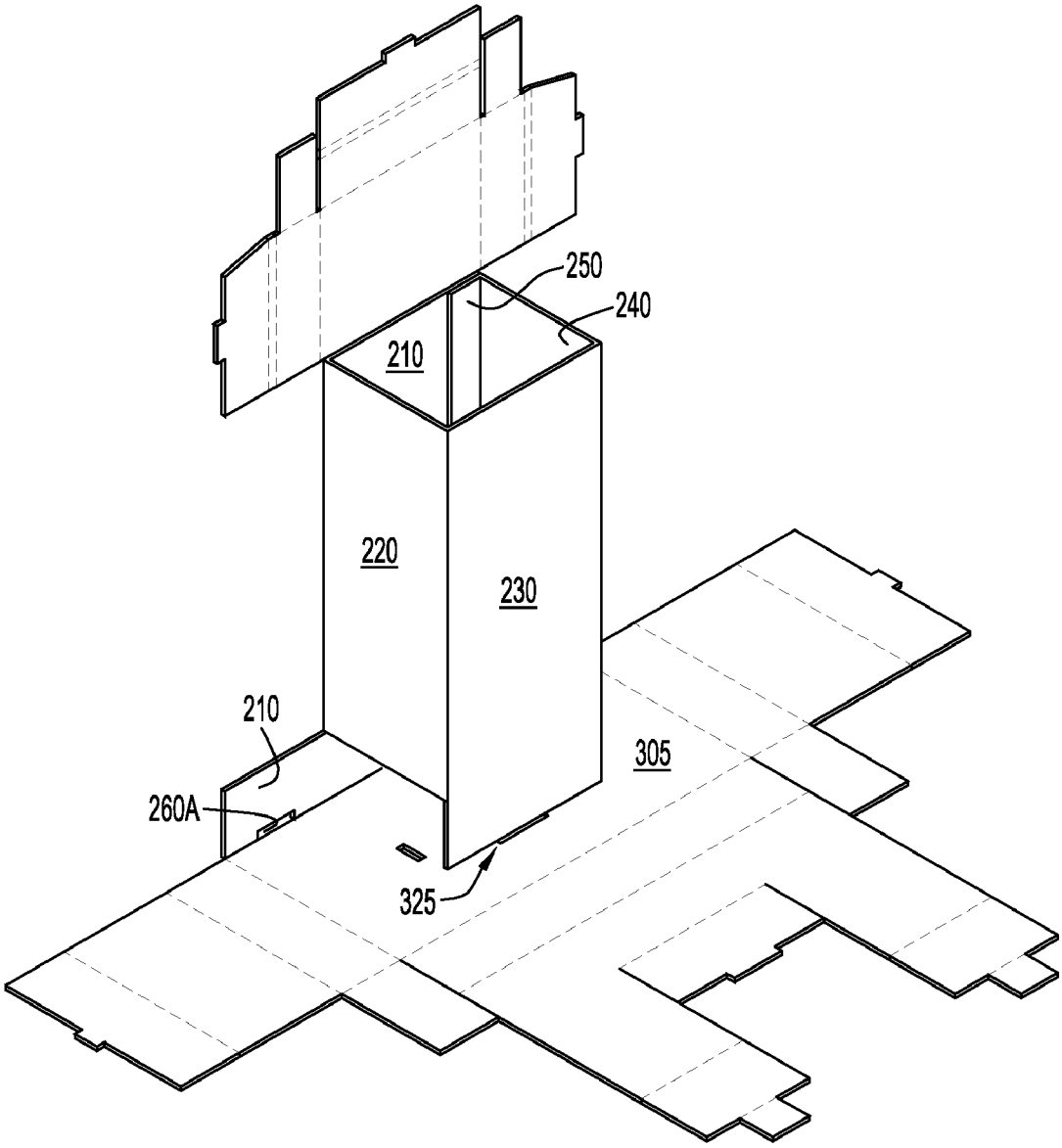

Referring to FIG. 4, the blank 10 may then be folded along fold line B, rotating the tower section 200 upward. As noted above, the lower edge of the front tower panel 230 mates with the longitudinal groove 335 of the slot 325 formed into the central pedestal panel 305, securing the tower upright. The resulting tower possesses a generally rectangular shape, with left and right side walls oriented between the notches 320A, 320B formed into the central panel 305 of the pedestal section 300.

Figure 5:
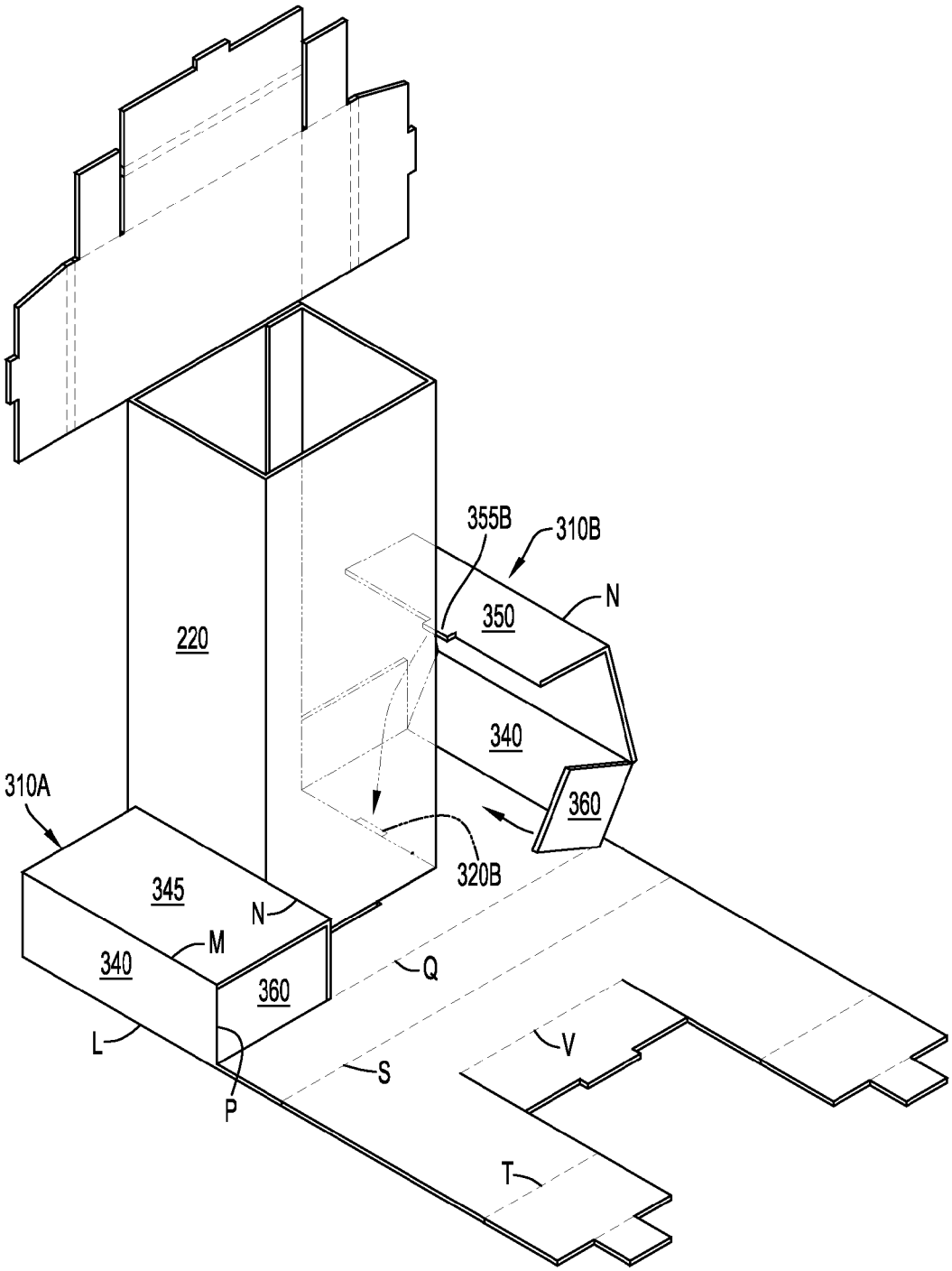
FIGS. 5-7 illustrate perspective views of the blank shown of FIG. 1, showing folding of the pedestal section along fold lines to form the pedestal of the container.

Next, the pedestal of the container is formed. Referring to FIG. 5, the left panel 310A is folded to form a left pedestal box. Specifically, the pedestal flap 360 is folded along fold line P such that is oriented generally orthogonal to the proximal panel portion 340. The left panel 310A is then pivoted about fold line L, folding the intermediate panel portion 345 and the distal panel portion 350 about respective along their respective fold lines M, N. The left locking tab 355A extending distally from the distal panel portion 350 is inserted into the first notch 320A, securely positioning the end panel portion 350 adjacent the left panel 220 of the tower and forming a generally rectangular pedestal box.

Similarly, the right pedestal panel 310B is folded to form a right pedestal box. That is, the flap 360 is folded along fold line P such that is oriented generally orthogonal to the proximal panel portion 340. The right pedestal panel 310B is pivoted about fold line L, folding the intermediate panel portion 345 and the distal panel portion 350 about along their respective fold lines M, N. The right locking tab 355B extending distally from the distal panel portion 350 is inserted into the second notch 320B, securely positioning the end panel portion 350 adjacent the right panel 240 of the tower and forming a generally rectangular pedestal box.

Figure 6:
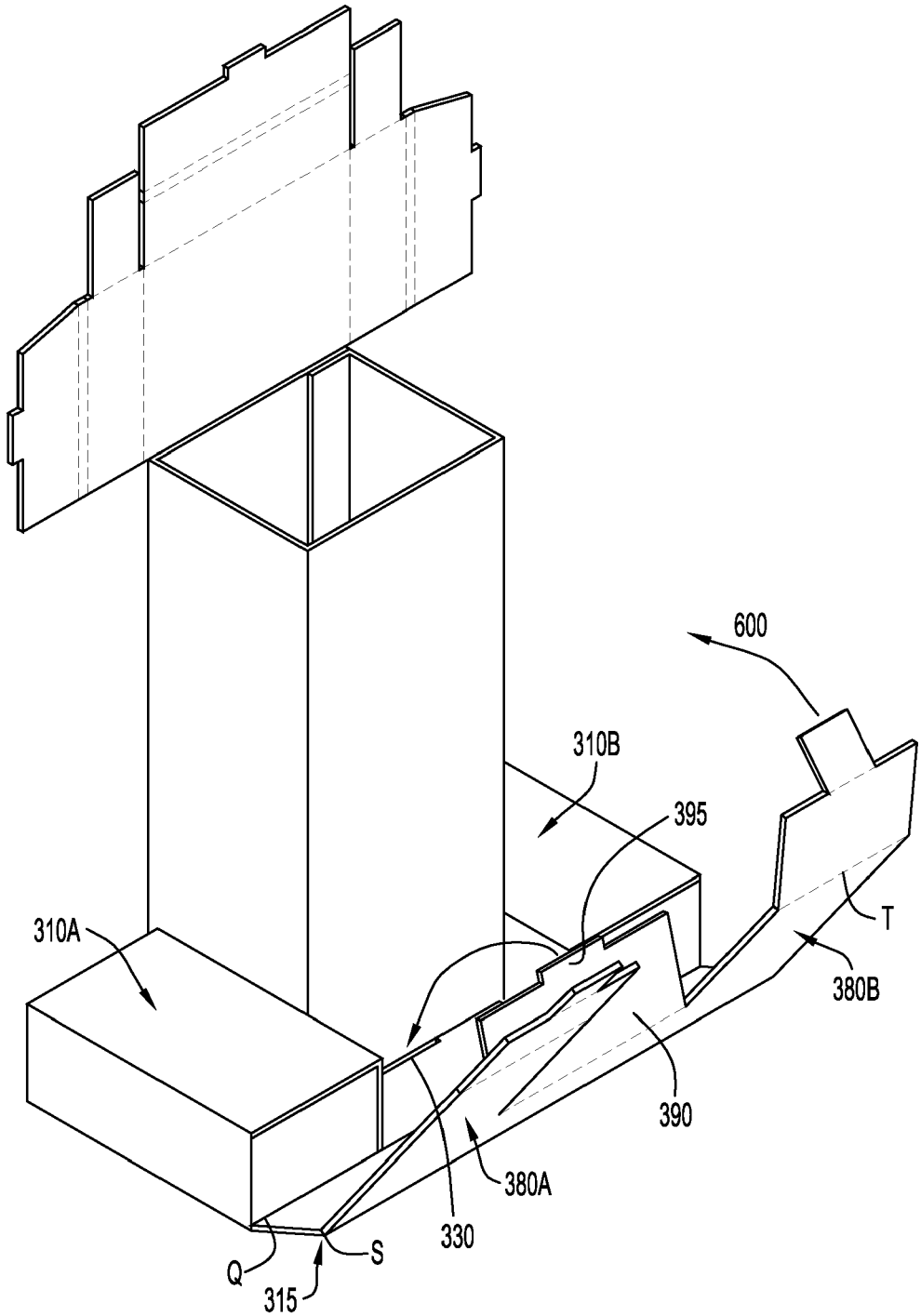
Figure 7:
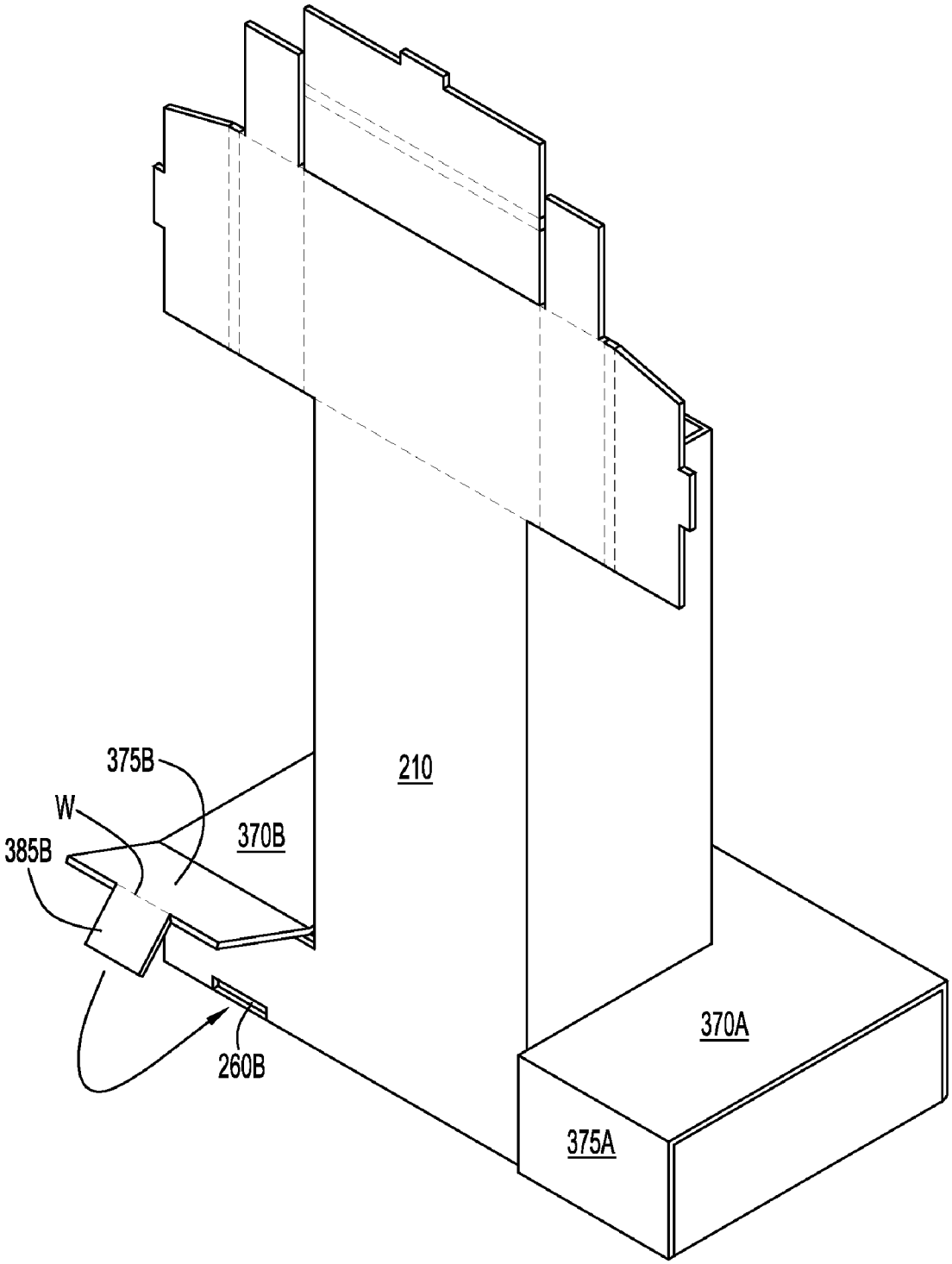

Referring to FIG. 6, the top panel 315 is then folded along fold lines Q, S, T to wrap the top panel around the top of the pedestal boxes. Specifically, the top wall 315 is rotated upward (indicated by arrow 600), toward the tower such that the first arm 380A is folded over the left pedestal box and the second arm 380B is folded over the right pedestal box. The flap 390 is folded about fold line V such that the flap tab 395 is inserted into the median groove 330 of the elongate slot 325 formed in the central panel 305. As shown in FIG. 7, the arms 380A, 380B are folded to orient the distal panel portions 375A, 375B adjacent the back of the pedestal boxes. The first tab 385A is folded along fold line W and inserted into the first slot 260A, while the second tab 385B is folded along fold line W and inserted into the second slot 260B. In this manner, the pedestal sufficient to support the tower upright (even when filled) is formed.

Figure 8:
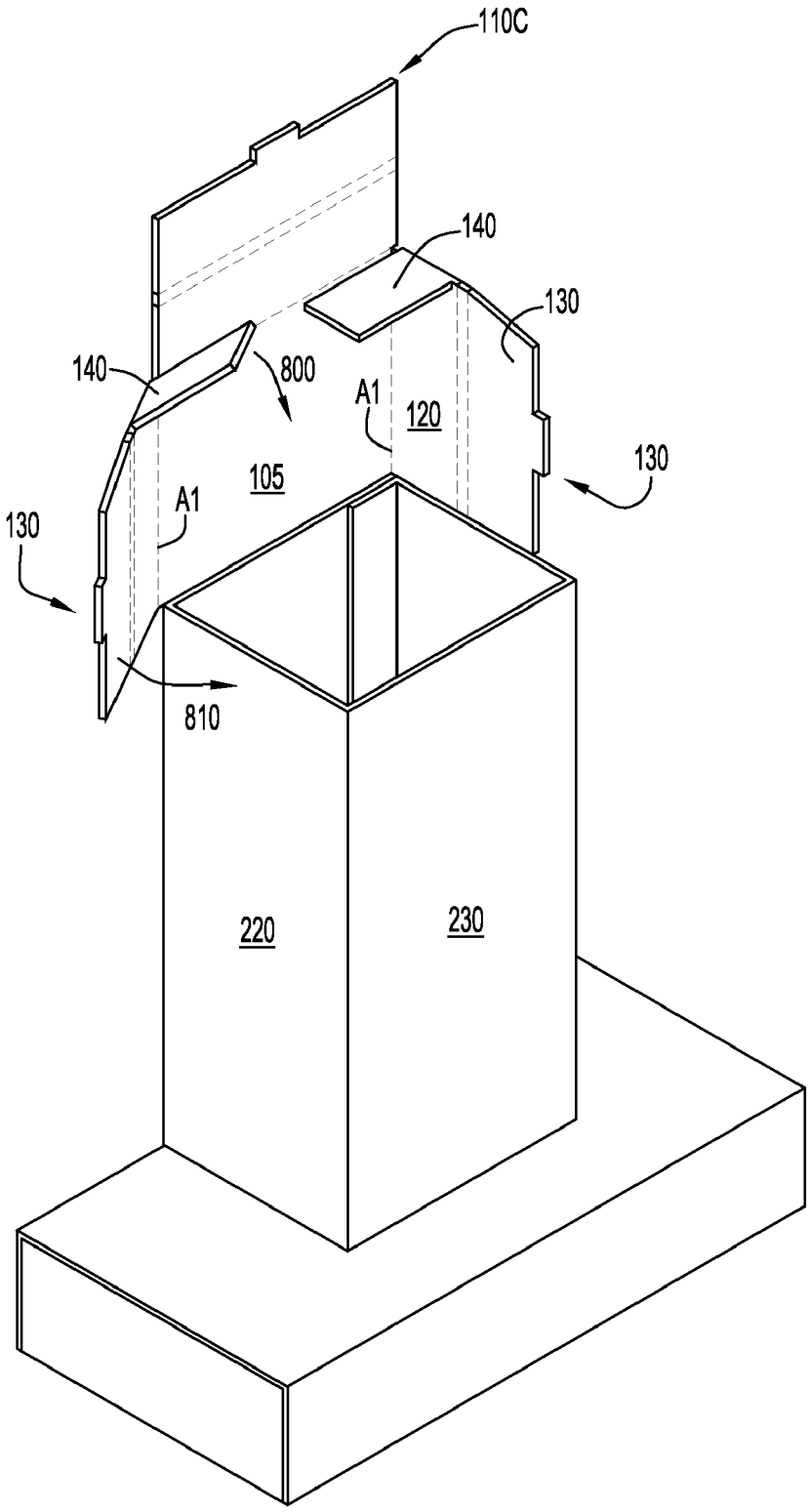
FIGS. 8-10 illustrate perspective views of the blank shown of FIG. 1, showing folding of the lid section along fold lines to form the lid of the container.

Next, the lid of the container may be formed. Referring to FIG. 8, the lid section 100 is folded along fold line A. The lid flaps 140 are folded along fold line E such that the flaps are oriented generally orthogonal to their respective proximal panel portions 120 (indicated by arrow 800). Each proximal panel portion 120 is then folded along fold line A1 to orient the left and right lid panels 110A, 110B generally transverse to the central panel 105 (indicated by arrow 810).

Figure 9:
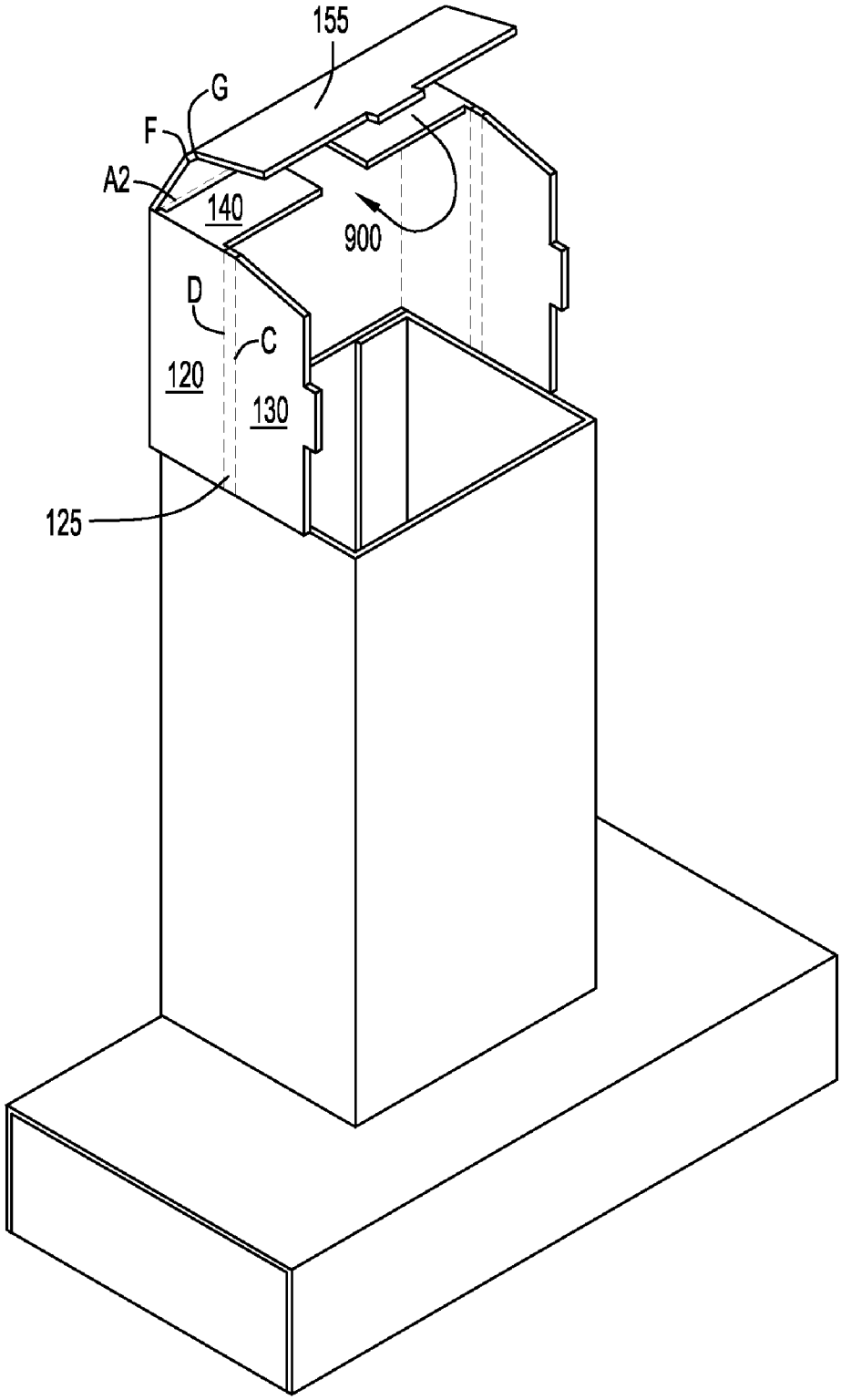
Figure 10:
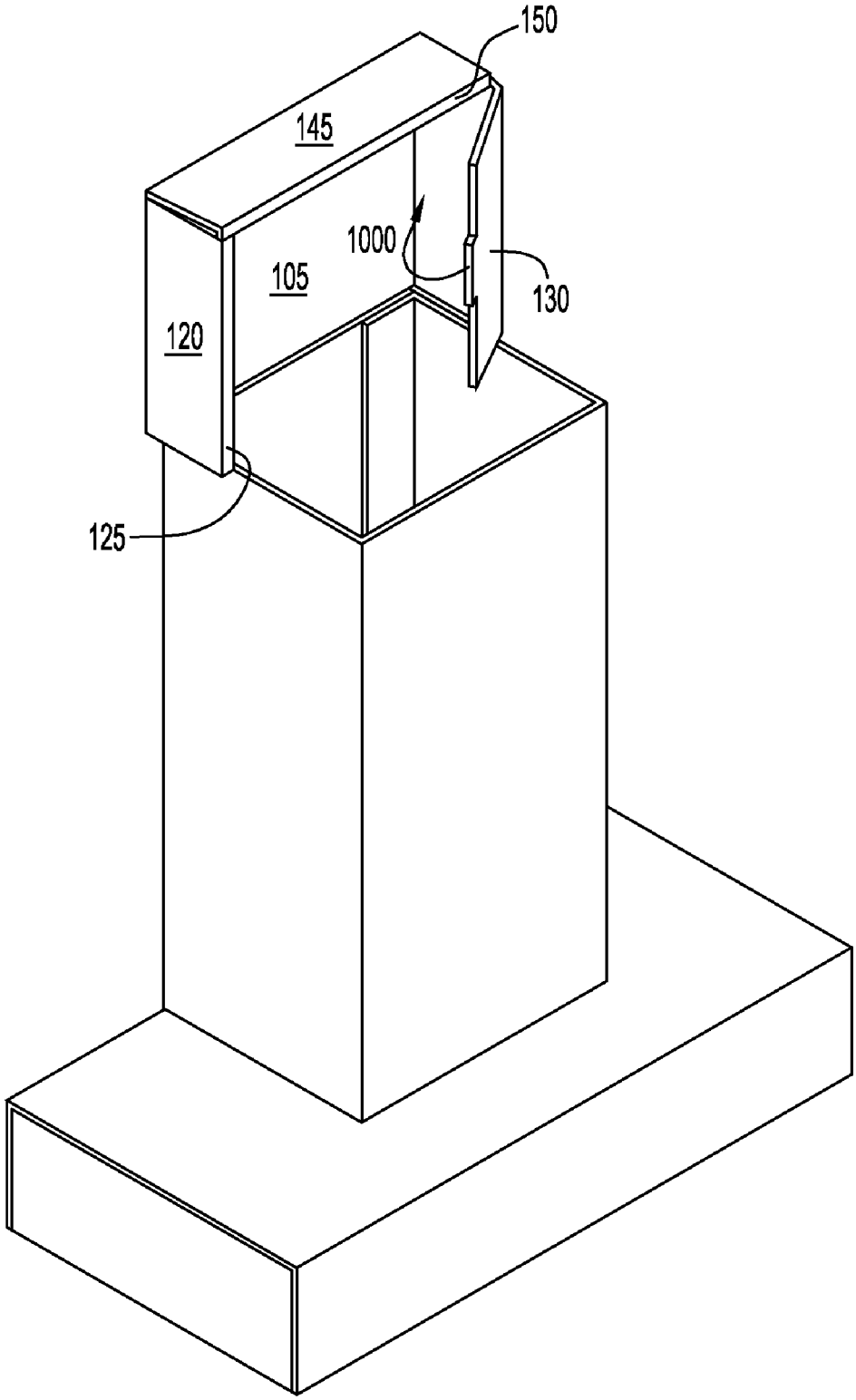

Referring to FIG. 9, the front panel 110C is then folded along fold line A2 such that it is generally transverse to central panel 105 (indicated by arrow 900). The distal panel portion 155 and the intermediate panel portion 150 are folded along fold lines F and G, respectively, wrapping the panel portions around the lid flaps 140. Similarly, as shown in FIG. 10, the distal panel portions 130 of the left lid panel 110A and the right lid panel 110B are folded along fold lines C, D (indicated by arrow 1000). In this manner, the lid is formed. As noted above, the pressure tabs 135, 160 extending distally from the distal portion 130, 155 of the lid panels 110A, 100B, 110C frictionally engage the surface of the central panel 105, securing the lid walls in place. Alternatively notches, grooves or slots may be formed into the surface of the central panel 105 that are configured to receive the pressure tabs 135, 160.

Figure 11:
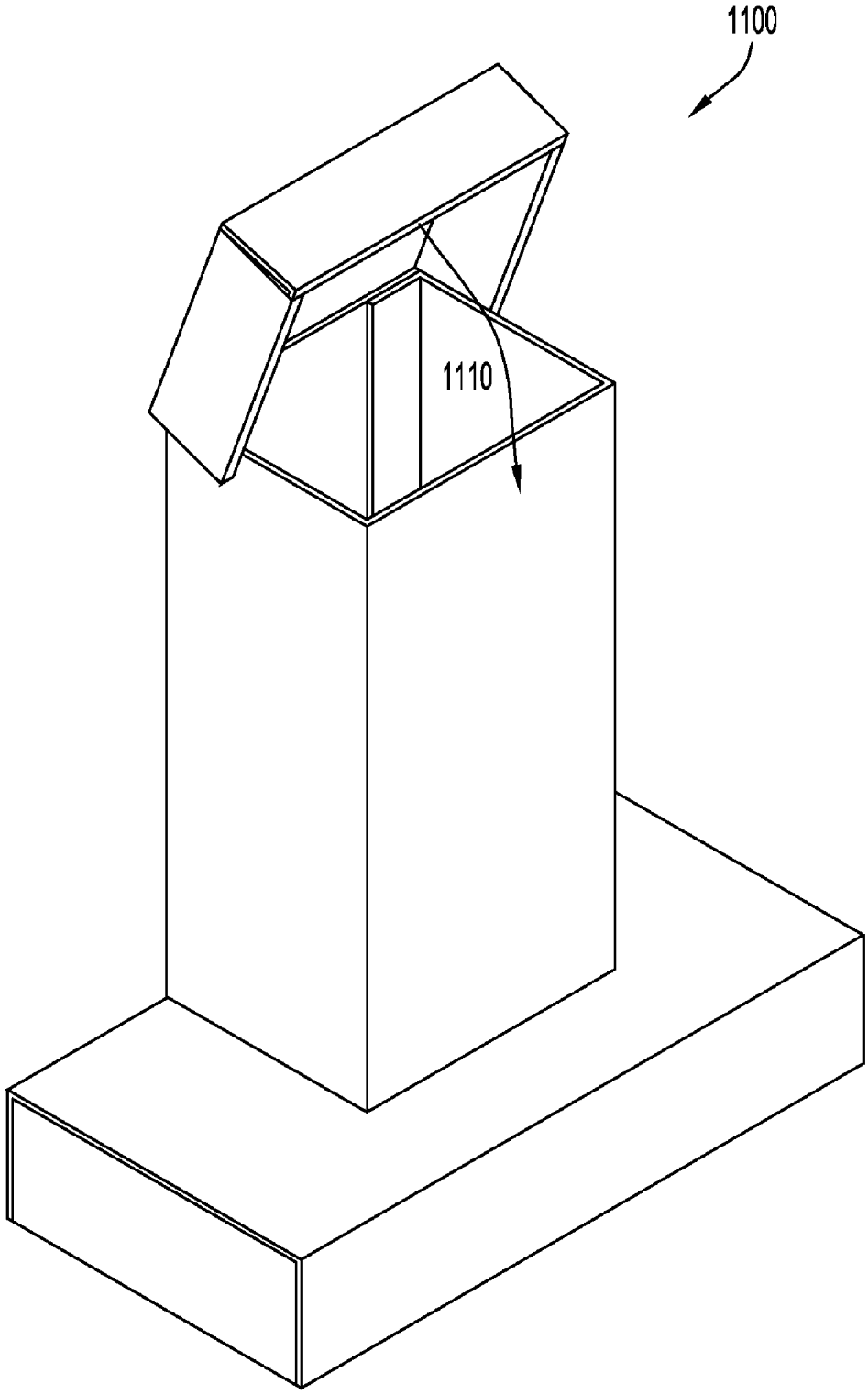
FIGS. 11-12 illustrate perspective views of a container in accordance with the embodiment of the invention resulting from the blank shown in FIG. 1.
Figure 12:
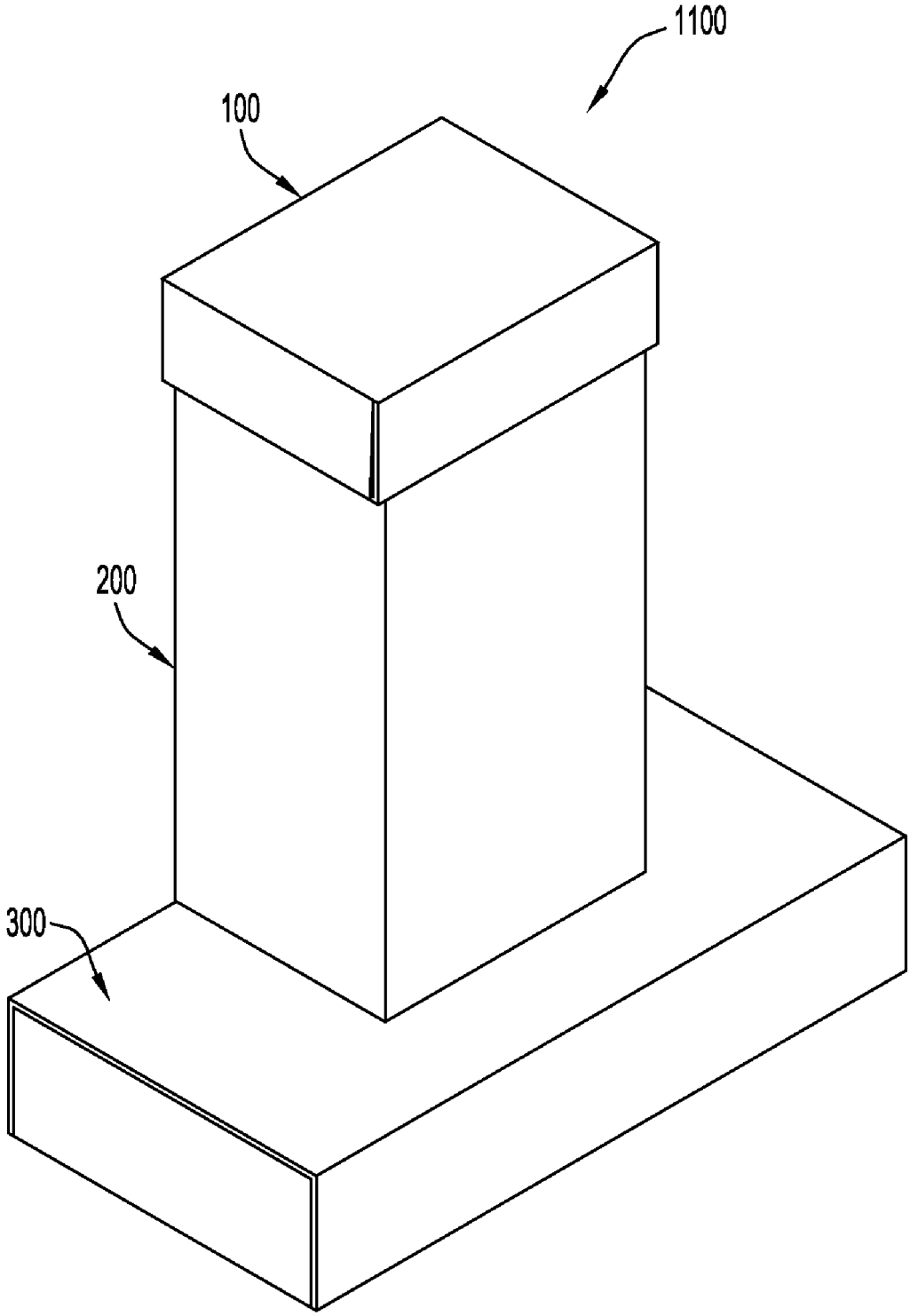

Referring to FIGS. 11 and 12, the blank 10 is shown in its folded form, providing a container 1100 having a lid hinged along fold line A2 (indicated by arrow 1110) such that it may selectively cover the chamber of the tower.

The resulting container 1100 may be utilized to store/display items. In a particular embodiment, the container may be stylized as a trophy presented in honor of an accomplishment or an occasion reached by the recipient. For example, the exterior surface of the container may be coated with metallic paint or ink. The exterior surfaces of the container may be personalized by having photographs, designs, or holograms relevant to the recipient, imprinted or otherwise placed thereon.

The trophy may serve as a container for items to be given to the trophy recipient. The items in the container typically pertain to the recipient's interests or to an accomplishment achieved by the recipient. For example, for a golfer on the occasion of his/her birthday, or in recognition of a tournament win, the container may be filled with golf balls, tees, golf shoes, gift certificates, etc. By way of further example, for a child's birthday party, the items in the container may be toys, games, candy, clothes, etc.

A conventional type of award symbol, such as a cup, figurine, or plaque, with a theme personalized for the user, may be secured at the top of the container (i.e., to the lid) to signify the occasion and serve as a keepsake for the recipient. The symbol would range in size and height as determined by the occasion.

The blank 10 may be a component of a kit including the blank and a set of instructions that instruct a user on how to form the container from the blank. The kit may further include items suitable to decorate the container/blank, including (but not limited to) markers, glitter, paint, crayons, pencils, inkjet printing, decorative paper, wrapping paper, etc.

While the invention has been described in detail and with reference to specific embodiments thereof, it will be apparent to one skilled in the art that various changes and modifications can be made therein without departing from the spirit and scope thereof. For example, the blank 10 may possess any number of panels having any shape and dimensions suitable for its described purpose. The blank 10 may be formed of any suitable material, and the container may be printed or decorated utilizing conventional mechanisms. Similarly, the lid section 100, the tower section 200, the pedestal section 300 may possess any suitable shape or dimensions. Each section 100, 200, 300, moreover, may possess any number of panel portions, slots, grooves, and tabs. For example, while the entire front panel 230 of the tower section is shown to extend into longitudinal groove of the elongated slot 325, the front panel may be include a tab extending distally from the panel, with the longitudinal groove being sized accordingly (e.g., shortened in length to be comparable to the size of the tab). The container 1100 may store/display any number and/or type of items.

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

I claim:

1. A container blank defined by a single sheet of material, the container blank comprising:

a lid section including:

a central lid panel, a left lid panel coupled to the central lid panel via a first lid fold line, a right lid panel coupled to the central lid panel via a second lid fold line, and a front lid panel coupled to the central lid panel via a third lid fold line;

a tower section coupled to the lid section via a first section fold line, the tower section comprising a plurality of tower panels configured to form a compartment capable of receiving an item; and a pedestal section coupled to the tower section via a second section fold line, the pedestal section including a slot adapted to engage a tower panel, wherein the pedestal section supports the tower section in a generally upright orientation, wherein the blank forms a container having:

a pedestal, an elongated tower supported by the pedestal, wherein the tower defines the compartment configured to receive an item, and wherein the compartment is oriented directly above the pedestal, and a lid hinged to the tower and operable to selectively cover the compartment of the tower section, and wherein the tower section further includes a slot disposed proximate the second section fold line, said slot configured to engage a tab formed into the pedestal portion.

2. The container blank of claim 1, wherein:

the central lid panel includes a left edge, a right edge, a top edge, and a bottom edge;

the left lid panel is hinged along the left edge;

the right lid panel is hinged along the right edge; and the front lid panel is hinged along the top edge.

3. The container blank of claim 2, wherein each of the left lid panel, right lid panel, and the front lid panel comprises:

a proximal panel portion coupled to the central lid panel via a proximal fold line, an intermediate panel portion coupled to the proximal panel portion along an intermediate fold line, and a distal panel portion coupled to the intermediate panel portion via a distal fold line.

4. The container blank of claim 3, wherein the proximal panel portion of the left and right lid panels further comprises a flap, each flap foldable along a flap fold line.

5. The container blank of claim 1, wherein the tower section comprises:

a first tower panel;

a second tower panel coupled to the first tower panel via a first tower fold line;

a third tower panel coupled to the second tower panel via a second tower fold line;

a fourth tower panel coupled to the third tower panel via a third tower fold line; and a tower end flap hinged to the fourth tower panel via a fourth tower fold line.

6. The container blank of claim 5, wherein the tower end flap is continuous with the fourth tower panel, and includes a fastener operable to secure the end flap to a surface of the first tower panel.

7. The container blank of claim 6, wherein:

the first tower panel comprises an interior surface and an exterior surface; and the fastener comprises a strip of double-sided adhesive tape adhered to the interior surface of the first tower panel.

8. The container blank of claim 1, wherein the pedestal section comprises:

a left pedestal panel coupled to the central pedestal panel via a first pedestal fold line;

a right pedestal panel coupled to the central pedestal panel via a second pedestal fold line; and a front pedestal panel coupled to the central pedestal panel via a third pedestal fold line.

9. The container blank of claim 8, wherein:

the left pedestal panel comprises:

a proximal panel portion, an intermediate panel portion hinged to the proximal panel portion, and a distal panel portion hinged to the intermediate panel portion; and the right pedestal panel comprises:

a proximal panel portion, an intermediate panel portion hinged to the proximal panel portion, and a distal panel portion hinged to the intermediate panel portion.

10. The container blank of claim 1, wherein the front lid panel comprises a generally U-shaped structure including a first arm, a medial portion, and a second arm disposed in spaced relation from a first arm to define a well.

11. The container blank of claim 1, wherein:

the plurality of tower panels comprises a first tower panel coupled to a second tower panel, the first tower panel is coupled to the lid section via first section fold line and to the pedestal section via the second section fold line;

the first tower panel comprises the slot;

the pedestal section includes U-shaped portion having a first arm a medial portion, and a second arm; and at least one of the first and second arms includes the tab configured to engage the first tower panel slot.

12. A method of forming a container comprising:

(a) obtaining a container blank defined by a single sheet of material, the blank including:

a lid section comprising foldable lid panels, the lid section including a central lid panel, a left lid panel coupled to the central lid panel via a first lid fold line, a right lid panel coupled to the central lid panel via a second lid fold line, and a front lid panel coupled to the central lid panel via a third lid fold line, a tower section coupled to the lid section via a first section fold line, the tower section comprising a plurality of tower foldable tower panels capable of forming a compartment configured to receive an item, and a pedestal section comprising a plurality of repositionable pedestal panels, the pedestal section being coupled to the tower section via a second section fold line, the pedestal section including a slot adapted to receive a tower panel and to support the tower section in a generally upright orientation wherein the tower section further includes a slot disposed proximate the second section fold line, said slot configured to engage a tab formed into the pedestal portion;

(b) folding the tower panels to form a tower defining a compartment operable to hold an item;

(c) folding the pedestal panels to form a pedestal, the pedestal operable to support the tower in a generally upright orientation; and (d) folding the lid panels to form a lid pivotally coupled to the tower, the lid operable to selectively cover the tower compartment, wherein the blank forms a container having a pedestal; an elongated tower supported by the pedestal and oriented directly above the pedestal, the elongated tower defining the compartment configured to receiving an item; and a lid hinged to the tower and operable to selectively cover the compartment of the tower section.

13. The method of claim 12, wherein:

(d) comprises (d.1) folding the left lid panel such that it is oriented generally orthogonal to the central panel, (d.2) folding the right lid panel such that it is oriented generally orthogonal to the central panel, and (d.3) folding the front lid wall such that it oriented generally orthogonal to the central panel.

14. The method of claim 13, wherein:

the plurality of tower panels comprises:

a first tower panel coupled to a second tower panel along a first tower fold line, a third tower panel coupled to the second tower panel wall along a second tower fold line, and a fourth tower panel coupled to the third tower panel along a third tower fold line; and (b) comprises (b.1) folding the tower section to orient the first and third panels in generally parallel, spaced relation, as well as to orient the second and fourth tower panels in generally parallel, spaced relation.

15. A container blank defined by a single sheet of material, the container blank comprising:

a lid section including:

a central lid panel, a left lid panel coupled to the central lid panel via a first proximal fold line, a right lid panel coupled to the central lid panel via a second proximal fold line, and a front lid panel coupled to the central lid panel via a third proximal fold line, wherein each of the left lid panel, right lid panel, and the front lid panel comprises a proximal panel portion coupled to the lid via the corresponding proximal fold line, an intermediate panel portion coupled to the proximal panel portion via an intermediate fold line, and a distal panel portion coupled to the intermediate panel portion via a distal fold line;

a tower section coupled to the lid section via a first section fold line, the tower section comprises a plurality of tower panels configured to form a compartment operable to receive an item; and a pedestal section coupled to the tower section via a second section fold line, the pedestal section including a central pedestal panel, and wherein the pedestal section engages a tower panel, wherein the blank forms a container having a pedestal, a tower extending upward from the pedestal, and a lid hinged to the tower and operable to selectively provide access to the compartment defined by the tower section.

16. The container blank of claim 15, wherein:

the central lid panel includes a left edge, a right edge, a top edge, and a bottom edge;

the left lid panel is hinged along the left edge;

the right lid panel is hinged along the right edge; and the front lid panel is hinged along the top edge.

17. The container blank of claim 15, wherein the proximal panel portion of the left and right lid panels further comprises a flap, each flap foldable along a flap fold line.

18. The container blank of claim 15, wherein the plurality of tower panels comprises:

a first tower panel;

a second tower panel coupled to the first tower panel via a first tower fold line;

a third tower panel coupled to the second tower panel via a second tower fold line;

a fourth tower panel coupled to the third tower panel via a third tower fold line; and a tower end flap hinged to the fourth tower panel via a fourth tower fold line.

19. The container blank of claim 18, wherein the tower end flap is continuous with the fourth tower panel.

20. The container blank of claim 15, wherein the pedestal section further comprises a first pedestal panel coupled to the central pedestal panel, the first pedestal panel comprising a generally U-shaped structure including a first arm, a medial portion, and a second arm disposed in spaced relation from a first arm.

21. A container blank defined by a single sheet of material, the container blank comprising:

a lid section including:

a central lid panel, a left lid panel coupled to the central lid panel via a first lid fold line, a right lid panel coupled to the central lid panel via a second lid fold line, and a front lid panel coupled to the central lid panel via a third lid fold line wherein the front lid panel comprises a generally U-shaped structure including a first arm, a medial portion, and a second arm disposed in spaced relation from a first arm to define a well;

a tower section coupled to the lid section via a first section fold line, the tower section comprising a plurality of tower panels configured to form a compartment capable of receiving an item; and a pedestal section coupled to the tower section via a second section fold line, the pedestal section including a slot adapted to engage a tower panel, wherein the pedestal section supports the tower section in a generally upright orientation, wherein the blank forms a container having:

a pedestal, an elongated tower supported by the pedestal, wherein the tower defines the compartment configured to receive an item, and wherein the compartment is oriented directly above the pedestal, and a lid hinged to the tower and operable to selectively cover the compartment of the tower section.

22. A container blank defined by a single sheet of material, the container blank comprising:

a lid section including:

a central lid panel including a left edge, a right edge, a top edge, and a bottom edge, a left lid panel coupled to the central lid panel via a first lid fold line, the left lid panel being hinged along the left central panel edge a right lid panel coupled to the central lid panel via a second lid fold line, the right lid panel being hinged along the right central panel edge, and a front lid panel coupled to the central lid panel via a third lid fold line, the front lid panel being hinged along the top central panel edge;

a tower section coupled to the lid section via a first section fold line, the tower section comprising a plurality of tower panels configured to form a compartment capable of receiving an item; and a pedestal section coupled to the tower section via a second section fold line, the pedestal section including a slot adapted to engage a tower panel, wherein the pedestal section supports the tower section in a generally upright orientation, wherein the blank forms a container having:

a pedestal, an elongated tower supported by the pedestal, wherein the tower defines the compartment configured to receive an item, and wherein the compartment is oriented directly above the pedestal, and a lid hinged to the tower and operable to selectively cover the compartment of the tower section, and wherein each of the left lid panel, right lid panel, and the front lid panel comprises:

a proximal panel portion coupled to the central lid panel via a proximal fold line, an intermediate panel portion coupled to the proximal panel portion along an intermediate fold line, and a distal panel portion coupled to the intermediate panel portion via a distal fold line.

* * * * *